US008398083B2

(12) United States Patent
Costa

(10) Patent No.: US 8,398,083 B2
(45) Date of Patent: Mar. 19, 2013

(54) CARD GAME

(75) Inventor: Peter Costa, Las Vegas, NV (US)

(73) Assignee: Poker 123, LLC, Las Vegas, NV (US)

( * ) Notice: Subject to any disclaimer, the term of this patent is extended or adjusted under 35 U.S.C. 154(b) by 83 days.

(21) Appl. No.: 12/948,490

(22) Filed: Nov. 17, 2010

(65) Prior Publication Data

US 2011/0115161 A1 May 19, 2011

Related U.S. Application Data

(60) Provisional application No. 61/261,845, filed on Nov. 17, 2009.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,294,128 A * 3/1994 Marquez ..... 273/292
5,669,817 A * 9/1997 Tarantino ..... 463/13
5,863,041 A * 1/1999 Boylan et al. ..... 273/292
5,863,042 A * 1/1999 Lo ..... 273/292
5,984,310 A * 11/1999 English ..... 273/292
6,155,568 A * 12/2000 Franklin ..... 273/292
6,443,455 B1 9/2002 Webb
6,474,646 B1 * 11/2002 Webb ..... 273/274
6,817,615 B1 * 11/2004 Dacey ..... 273/292
6,986,514 B2 * 1/2006 Snow ..... 273/292
7,059,604 B1 * 6/2006 Richards et al. ..... 273/292
7,118,111 B1 * 10/2006 Altomare ..... 273/292
7,407,163 B2 * 8/2008 Snow ..... 273/292
7,455,297 B2 * 11/2008 Tang ..... 273/292
7,520,509 B1 4/2009 Haber
8,128,091 B2 * 3/2012 Snow et al. ..... 273/292
2004/0127274 A1 7/2004 Franklin
2006/0119044 A1 * 6/2006 Kekempanos et al. ..... 273/292
2007/0035091 A1 2/2007 Tang
2008/0191417 A1 * 8/2008 Pham ..... 273/292
2010/0244382 A1 * 9/2010 Snow ..... 273/292
2011/0084449 A1 * 4/2011 Poon ..... 273/292
2012/0061915 A1 * 3/2012 Snow ..... 273/292

* cited by examiner

*Primary Examiner* — Kurt Fernstrom
*Assistant Examiner* — Dolores Collins
(74) *Attorney, Agent, or Firm* — Adams Monahan, LLP; J. R. Maddox

(57) ABSTRACT

A card game is disclosed in which participants arrange six poker cards into three hands, including a one-card hand, a two-card hand, and a three-card hand. Wagers are placed on each of the participant's hands. The participants compete their hands against at least one other participant's hands to determine who has the highest ranked hands. For each hand, the participant having the highest ranked hand is determined to be the winner. Payoffs are made to the winners.

13 Claims, 5 Drawing Sheets

CARD GAME

CROSS REFERENCE TO RELATED APPLICATIONS

This application claims priority to U.S. Provisional Application Ser. No. 61/261,845, filed on Nov. 17, 2009, entitled POKER 1-2-3, the disclosure of which is incorporated by reference herein in its entirety.

BACKGROUND

Card games are often played using a 52-card deck of playing cards. A variety of different types of card games exist. Some card games involve gambling. An example of a gambling card game is poker, in which players bet into a pool, called the pot. Each player receives a poker hand including a set number of cards. After betting has been completed, players compare their hands with each other to determine the winner. The pot is awarded to the winner.

SUMMARY

In general terms, the present disclosure relates to a card game in which each player's hand is divided into a one-card hand, a two-card hand, and a three-card hand.

One aspect is a method of playing a card game. The method comprises obtaining at least three wagers from a player; dealing at least six cards to the player as the player's cards; identifying three player hands from the player's cards, the three player hands including a one-card hand, a two-card hand, and a three-card hand; comparing each of the three player hands to at least three other hands including another one-card hand, another two-card hand, and another three-card hand; and for each of the three player hands, determining whether the player has won the wager, including determining if the player hand is higher than at least one of the other hands.

Another aspect is a computing device comprising a processing device and a memory device. The memory device storing instructions that, when executed by the processing device cause the processing device to: obtain at least three wagers from a player; deal at least six cards to the player as the player's cards; receive inputs assigning the player's cards into three player hands including a one-card hand, a two-card hand, and a three card hand; comparing the three player hands to three hands of another participant; and for each player hand, determining whether the player has won by determining whether the respective player's hand is higher than the respective participants hand.

DETAILED DESCRIPTION

Figure 1:
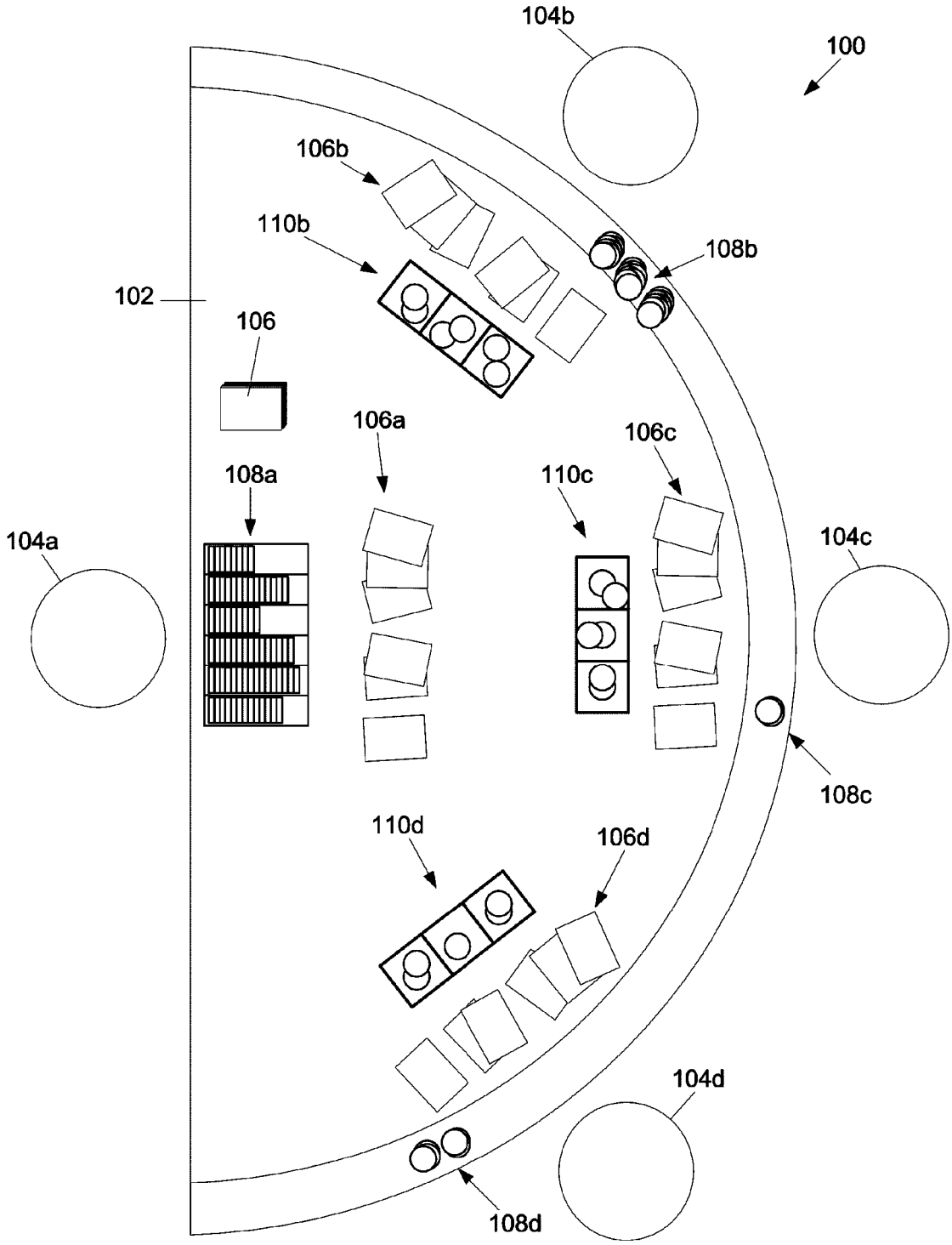
FIG. 1 is a schematic plan view of an example card game during game play.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Various embodiments of a card game are disclosed herein. As described further below, the card game can be played using one or more standard 52-card decks of cards. Some embodiments are played on a table. In other examples, the card game is played on one or more computing devices located at one or more homes or business establishments or in an online environment over a network such as the Internet. In some examples, when card games are played on computing devices, the computing devices generate visual representations of the components of the card game 100, as discussed herein, which are then displayed on a display device, such as a computer monitor or television screen, or projected by a video projector. Inputs are received from players through input devices coupled to the computing devices, such as a keyboard, a mouse, a touch sensitive display, a touch pad, or other input devices. In some embodiments, the actions of a dealer and/or one or more players are performed automatically by a computing device.

FIG. 1 is a schematic plan view of an example card game 100 during game play. The card game 100 includes a table 102, player positions 104, playing cards 106, and poker chips 108.

In some embodiments, table 102 is a piece of furniture that typically includes flat surface that is elevated from the floor. In some embodiments, the table is covered with felt or baize. Some embodiments include speed cloth, a fabric having a Teflon coating that helps cards slide across the surface. In other possible embodiments, table 102 is a dining room table, a card table, or other surface suitable for card play.

Table 102 has a semi-circular shape. Other embodiments of table 102 have a variety of other possible shapes, such as circular, rectangular, square, or other shapes.

In some embodiments, table 102 includes markings on the surface, such as to indicate proper player positions, to define regions of the table 102 for placing bets, to define regions of table 102 for placing player or dealer cards, to display the name or rules of the card game, or for other purposes such as discussed herein. In the example shown in FIG. 1, table 102 includes player bet regions 110 (including regions 110*b*, 110*c*, and 110*d*).

The players and the dealer (collectively referred to as participants) take a position around the table 102 as represented by positions 104. In some embodiments, players stand at positions 104. In other embodiments, positions 104 are chairs or stools that players can sit on during game play. In this example, the dealer takes the dealer position 104*a* and the players take player positions 104*b*, 104*c*, and 104*d*. Three player positions are shown in FIG. 1, but other embodiments include other quantities of player positions, such as one, two, four, five, six, etc. In some embodiments, dealer position 104*a* is a player position.

Playing cards 106 are typically one or more standard 52-card decks of playing cards. In some embodiments, playing cards 106 are made of paper, such as a heavy paper, thin card, or thin plastic. Playing cards 106 typically include a face surface and a back surface. The face surface typically includes markings thereon that distinguish the cards from other cards in the deck. The markings are also used to determine the permissible uses of each card according to the rules of the game being played, such as discussed in more detail herein. Examples of markings include printed indicia that identify the card as being one of an Ace, 2, 3, 4, 5, 6, 7, 8, 9, 10, Jack, Queen, and King, and also identify the card as being of a suit selected from diamonds, clubs, hearts, and spades, in some embodiments. Other embodiments include other cards.

Poker chips 108 (or other casino tokens) are used in some embodiments for keeping score. In some embodiments, a variety of different types of poker chips are used, such as poker chips having different colors. Each type of poker chip is assigned a different value. In some embodiments, the values are a cash value, while in other embodiments the value is used for score keeping, but is not directly tied to an actual cash value.

In some embodiments, regions of table 102 are designated for particular purposes during game play. In this example, table 102 includes, for example, dealer and player positions 104*a*, 104*b*, 104*c*, and 104*d*; card positions (containing dealer cards 106*a* and player cards 106*b*, 106*c*, 106*d*); poker chip positions 108*a*, 108*b*, 108*c*, and 108*d*, and player bet regions 110*b*, 110*c*, and 110*d*.

In some embodiments, the components of card game 100 are physical objects. In other embodiments, the components are virtual representations of physical objects that are generated by a computing device.

Figure 2:
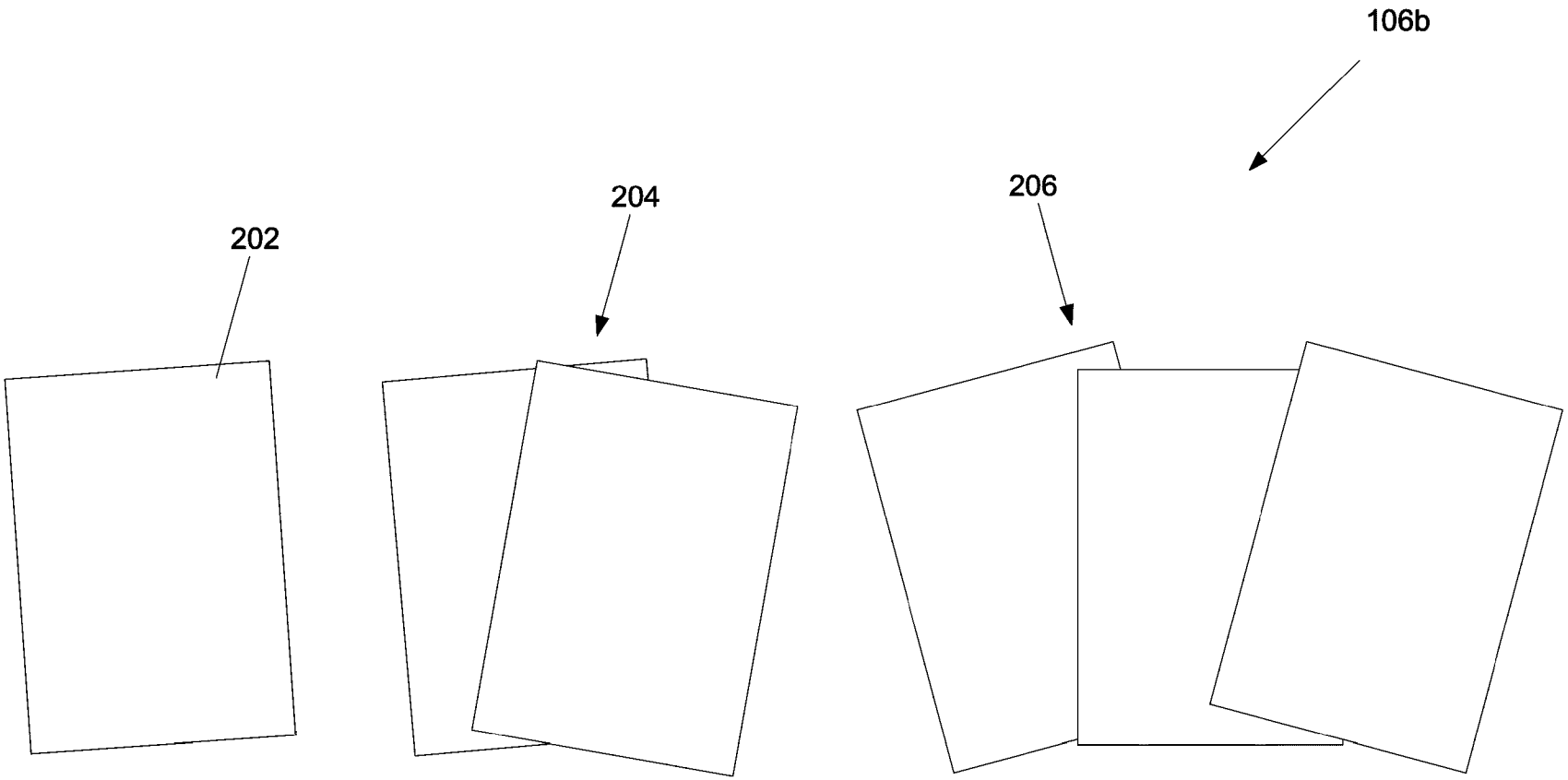
FIG. 2 is a schematic block diagram illustrating an example arrangement of cards of the card game shown in FIG. 1.

FIG. 2 is a schematic block diagram illustrating an example arrangement of cards 106, such as player cards 106*b*. In some embodiments, the players and the dealer arrange cards into an arrangement including a one-card hand 202, a two-card hand 204, and a three-card hand 206, as shown.

In this example, each player and the dealer have a total of six cards. However, other embodiments use other quantities of cards. For example, in some embodiments a total of seven cards are dealt to each player, and the player can discard one card before arranging the player cards 106*b* as shown in FIG. 2.

Dealer and player cards are compared to each other using a pre-determined ranking of hands. Some embodiments include a one-card hand ranking, a two-card hand ranking, and a three-card hand ranking Examples of each ranking are provided below, but other embodiments utilize other rankings.

An example of a one-card hand ranking is based on the highest card, where Ace is the highest and Deuce (Two) is the lowest. In another possible embodiment, Ace is low and King is high.

An example of a two-card hand ranking is as follows (from highest to lowest): a royal flush including an Ace and a King of the same suit; straight flush including two connected cards of the same suit (for example: Ten of hearts and Jack of hearts); pair; straight including two consecutive cards of different suits (for example: Ten of hearts and Jack of clubs); flush including two non-consecutive cards of the same suit; and high card.

An example of a three-card hand ranking is as follows: royal flush including an Ace, King and Queen of the same suit; a straight flush including three consecutive cards of the same suit (for example: Ten, Jack and Queen of the same suit); three-of-a-kind; straight; flush; pair; and high card.

Figure 3:
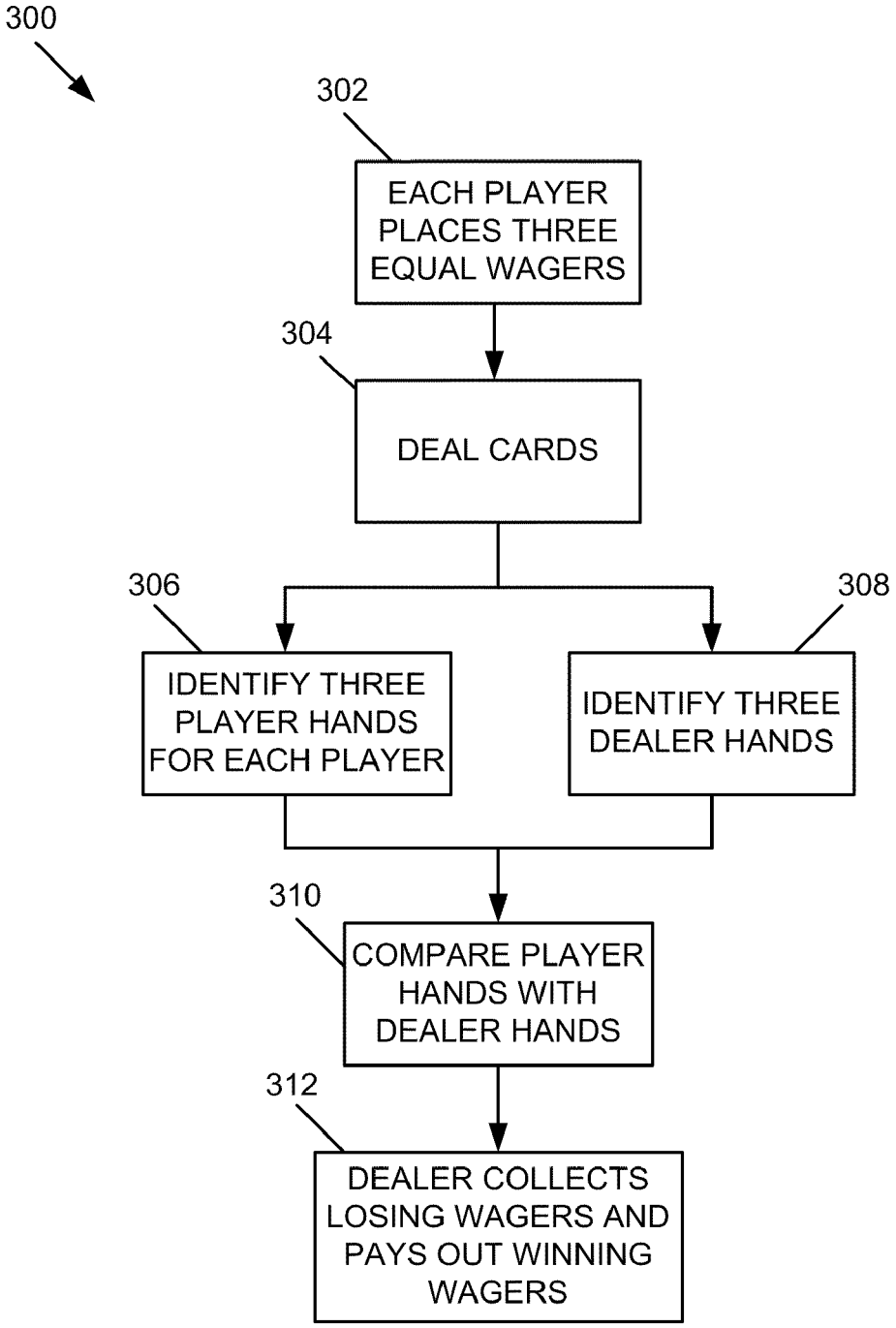
FIG. 3 is a flow chart illustrating an example method of playing the card game shown in FIG. 1.

FIG. 3 is a flow chart illustrating an example method 300 of playing card game 100, shown in FIG. 1. In this example, method 300 includes operations 302, 304, 306, 308, 310, and 312.

In some embodiments, game play begins with operation 302. In operation 302 each player places three wagers. The players place one wager for each hand, including a first wager for the one-card hand, a second wager for the two-card hand, and a third wager for the three card hand. Wagers are made, for example, by placing one or more poker chips 108 onto table 102 (shown in FIG. 1) for each hand, such as within designated bet regions 110.

In some embodiments, each of the three wagers placed by a player must be of equal value. For example, if two poker chips are bet for the one-card hand, then two poker chips must also be bet for the two-card hand and for the three-card hand. But, in some embodiments players can bet different amounts than other players.

In another possible embodiment, additional poker chips can be bet for the one-card hand, in addition to the three equal wagers. In yet another embodiment, a player can bet any amount for any of the three hands, and such bets need not be of equal value for each hand.

In this example, operation 302 occurs before cards are dealt in operation 304. In other possible embodiments, operation 302 can occur after one or more cards have been dealt. In yet further embodiments, additional betting occurs during game play after one or more cards have been dealt.

Method 300 includes operation 304 in which cards are dealt to each player. In some embodiments, operation 304 is performed by a dealer who deals an appropriate number of cards, such as six cards, to each player. In some embodiments, cards are dealt in two lots of three.

In some embodiments, operation 304 includes shuffling one or more decks of cards and dealing cards in a clockwise order to each participant, starting with the player immediately to the left of the dealer. In some embodiments the starting position rotates. Other embodiments include other dealing orders. In some embodiments, operation 304 includes cutting the deck and may also include burning one or more cards prior to or during the deal.

Operations 306 and 308 are then performed to form the three poker hands for each participant. During operation 306, three poker hands are identified for each player based on the six cards that were dealt to each player. During operation 308, three poker hands are identified for the dealer based on the six cards dealt to the dealer. In some embodiments operations 306 and 308 occur at the same time. In other embodiments operation 306 occurs prior to operation 308. In yet another embodiment, operation 308 occurs before operation 306.

In operation 306, each player studies the cards that have been dealt to that player, and arranges the cards into three hands. For example, the player selects one card to make up the one-card hand, two cards to make up the two-card hand, and three cards to make up the three-card hand. In some embodiments the cards are then placed face down on the table. In another embodiment, the cards remain in the player's hand. In yet another embodiment, the cards are laid face up on the table.

In some embodiments, the player is permitted to sort the cards in any way that the player wants to in order to make up the three hands. In another embodiment, the assignment of cards to each hand is performed according to rules, such as the same rules as the dealer has to use in some embodiments, as discussed below. In some embodiments, the players are permitted to get assistance from the dealer to properly arrange their hands according to the rules.

In operation 308, the dealer arranges the six cards dealt to the dealer into three hands, including a one-card hand, a two-card hand, and a three-card hand.

In some embodiments, the dealer arranges the cards according to rules. An example of the dealer's rules is as follows. The dealer must choose the highest card for the one-card hand followed by the best two-card hand. If the dealer has a choice of two or more cards to choose from for the one-card hand, then the dealer must make the choice that optimizes the dealer's best two-card hand. The same applies to the two-card hand.

For example, the dealer is dealt Ace of hearts, Ace of spades, King of hearts and three other random cards. In such a case, the dealer is forced to use the Ace of spades for the one-card hand in order to arrange the Ace of hearts and King of hearts for the best two-card hand.

On rare occasions, the dealer may still have an option after arranging the best two-card hand. In such cases, the dealer would optimize the best three-card hand, as long as that does not alter what would be the best one-card hand.

For example, the dealer's six card are as follows: Ace of hearts, Ace of clubs, Nine of spades, Eight of spades, Five of hearts and Three of hearts. In this example, the dealer has an option of which Ace to select for the one-card hand. Therefore, the dealer finds the best two-card hand first. In this case, the Nine of spades and the Eight of spades make up a straight-flush as the best two-card hand. At this stage, the dealer still holds two Aces. However, as one of the two Aces forms a flush for the three-card hand (Ace, Five and Three, all hearts), the dealer will arrange that hand before being left with the Ace of spades as the one-card hand.

In operation 310, each hand of each players hand is compared against the dealer's hand to determine whether the player has won or lost the bet against the dealer. If the cards have not yet been placed on the table, operation 310 involves displaying cards face up on the table. Displaying the cards can be done all at once, or one hand at a time in different embodiments.

For example, a first player's one-card hand is compared to the dealer's one-card hand. If the player has a higher card than the dealer, the player wins that hand. If the dealer has a higher card than the player, or the dealer's card is equal to the player's card, then the player loses that hand. The dealer wins all ties in some embodiments. The comparison continues for each of the three hands for each player.

In operation 312 the dealer collects losing wagers and pays out winning wagers. Players get paid one for one on each winning poker hand. If the player's hand beats the dealer's hand, the dealer pays out an amount equal to the player's bet to that player. If the player's hand loses to the dealer's hand, the player loses his bet to the dealer.

Players have the option to place a larger wager on the one-card hand, in some embodiments.

In some embodiments, an optional wager is also offered for a player to beat the dealer on all three hands. In some embodiments, if a player wins on this bet, the dealer would pay out 6 to 1, 7 to 1, or 8 to 1.

If the final math indicates that the player has an advantage over the dealer, some embodiments include a vigorish—an amount of each bet that the house gets to keep. The size of the vigorish would be dependent on the math. For example, a vigorish of 5%. Some embodiments include an entry fee that is collected by the house.

Depending on the math some embodiments include an option for the dealer to receive seven cards as standard. This will depend on the house required by casinos. In this embodiment, a player may pay an amount (e.g., 5% of their wager) in order to receive the seventh card. In another possible embodiment, all participants receive seven cards during operation 304 and one card is then discarded by the participant.

Figure 4:
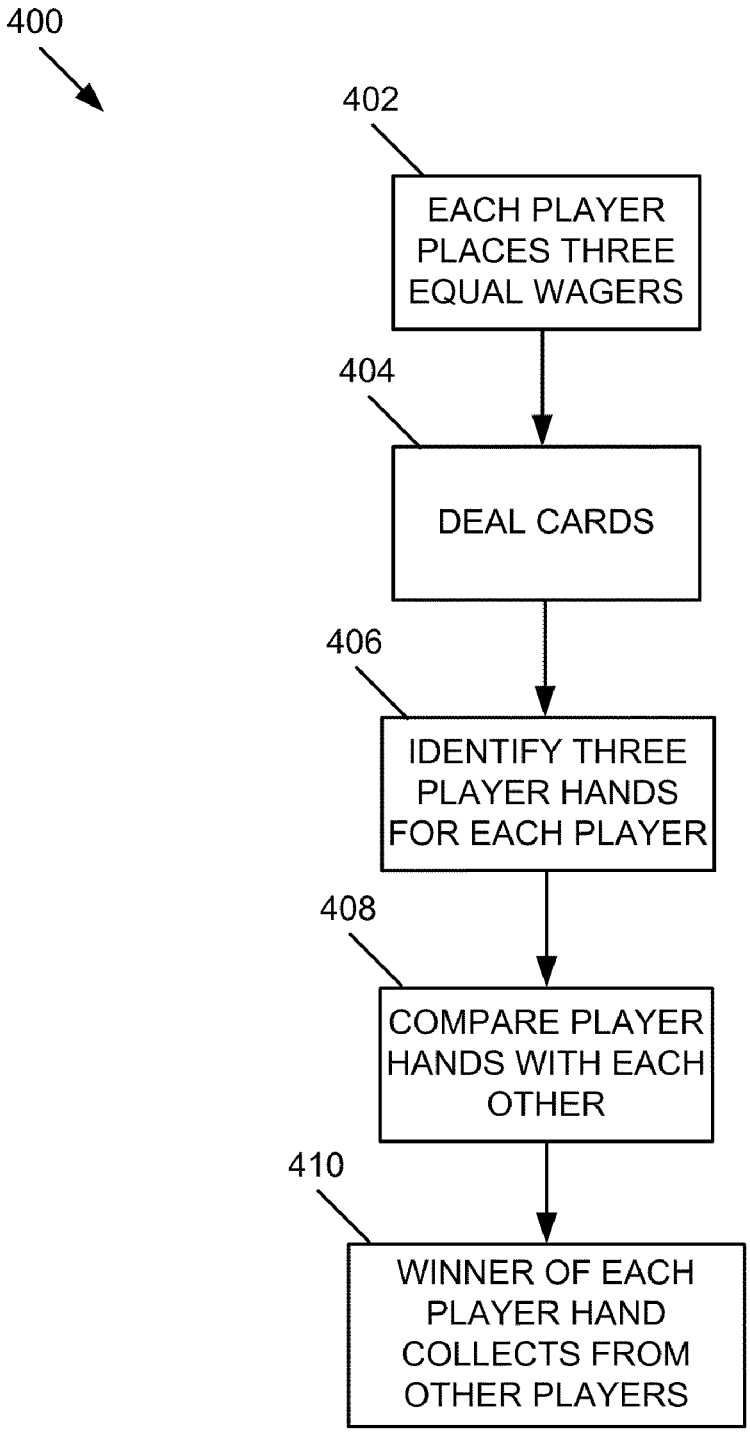
FIG. 4 is a flow chart illustrating another example method of playing the card game shown in FIG. 4.

FIG. 4 is a flow chart illustrating another example method 400 of playing card game 100, shown in FIG. 1. In this example, method 400 includes operations 402, 404, 406, 408, and 410, in which players compete against each other (i.e., player versus player), rather than against the dealer.

Players place wagers in operation 402, such as an equal wager for each hand, with a total of three wagers per player. In another embodiment, players are permitted to place any bet they desire on any of the hands. In yet another embodiment, all players must place the same bets as each other.

Cards are then dealt in operation 404. In some embodiments, cards are dealt by one of the players. Dealing rotates among the players, in some embodiments, such as in a clockwise or counter-clockwise direction. Some embodiments include a dealer (who is not a player) that deals the cards for the players. In some embodiments, six cards are dealt to each player, such as in two lots of three cards.

After the cards have been dealt, three player hands are identified for each player in operation 406 based on the six cards that were dealt to that player. In some embodiments, players are permitted to make their own selections of what cards to arrange in each hand. In other embodiments, players must arrange the cards according to rules, such as the dealer's rules discussed above.

Operation 408 is then performed to compare each of the player's hands with the other player's hands. In this example, instead of competing against the dealer, players all compete against one another. Thus, the player with the highest one-card hand wins that hand against all other players, the player with the highest two-card hand wins that hand against all other players, and the player with the highest three-card hand wins that hand against all other players.

Operation 410 is performed in which the winner of each hand collects the bets from all other players.

In another possible embodiment, players are permitted to buy an extra card in order to improve their hand. The cost of buying an extra card would be dependent on the final math. In some embodiments, however, the cost to purchase an extra card is equal to the price of the player's original wager. For example, if a player originally bet $4 on each of the three hands, for a total original wager of $20, the cost to purchase an extra card would be $20 in some embodiments.

A bonus wager is introduced in some embodiments which can include a variety of payouts.

Figure 5:
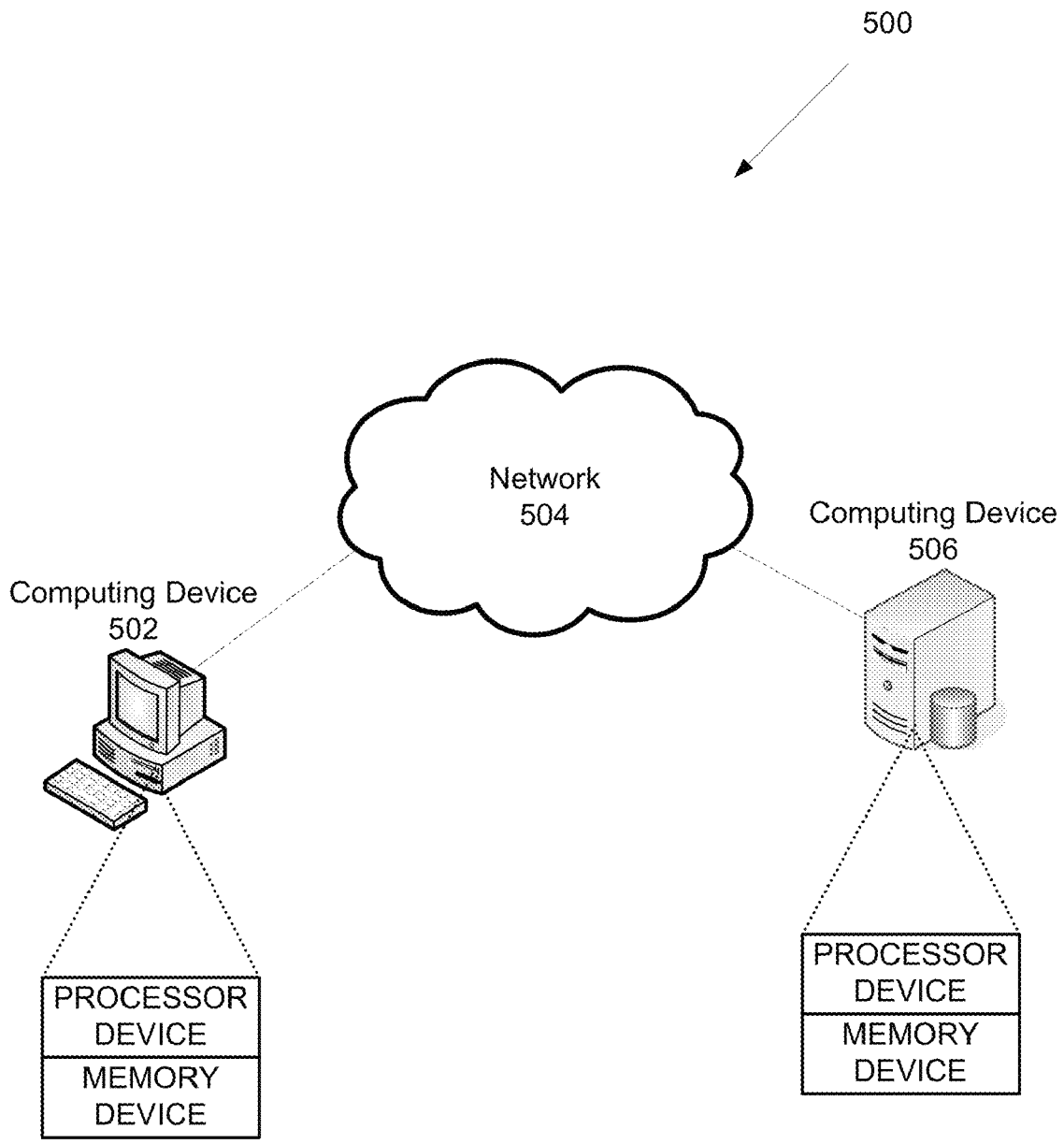
FIG. 5 is a schematic block diagram of an example computing system for playing the card game shown in FIG. 1.

FIG. 5 is a schematic block diagram of an example computing system 500. The example computing system 500 includes at least one computing device 502. In some embodiments the computing system 500 further includes a communication network 504 and one or more additional computing devices 506 (such as a server).

Computing device 502 can be, for example, located in a gaming establishment or can be a computing device located in a user's home. Computing device 502 can be a stand-alone computing device 502 or a networked computing device that communicates with one or more other computing devices 506 across network 504. Computing device 506 can be, for example, located remote from computing device 502, but configured for data communication with computing device 502 across network 504.

In some examples, the computing devices 502 and 506 include at least one processor device and a memory device, such as system memory. Depending on the exact configuration and type of computing device, the memory device may be volatile (such as RAM), non-volatile (such as ROM, flash memory, etc.) or some combination of the two. Memory device can include an operating system suitable for controlling the operation of the computing device, such as the WINDOWS® operating systems from Microsoft Corporation of Redmond, Wash. or a server, such as Windows SharePoint Server, also from Microsoft Corporation. The memory device may also include one or more software applications and may include program data.

The computing device may have additional features or functionality. For example, the device may also include additional data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. System memory, removable storage, and non-removable storage are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by the computing device.

In some examples, one or more of the computing devices 502, 506 can be located in an establishment, such as a casino or bar. In other examples, the computing device can be a personal computing device that is networked to allow the user to play card games disclosed herein at a remote location, such as in a player's home or other location. In some embodiments, computing device 502 is a SmartPhone or other mobile device. In some embodiments the rules of game play are stored as data instructions for a SmartPhone application. A network 504 facilitates communication between the computing device 502 and one or more servers, such as computing device 506, that host the card games. The network 504 may be a wide variety of different types of electronic communication networks. For example, the network may be a wide-area network, such as the Internet, a local-area network, a metropolitan-area network, or another type of electronic communication network. The network may include wired and/or wireless data links. A variety of communications protocols may be used for communication across network 504 including, but not limited to, Ethernet, Transport Control Protocol (TCP), Internet Protocol (IP), Hypertext Transfer Protocol (HTTP), SOAP, remote procedure call protocols, and/or other types of communications protocols.

In some examples, computing device 506 is a Web server. In this example, computing device 502 includes a Web browser that communicates with the Web server to request and retrieve data. The data is then displayed to the user, such as using a Web browser software application. In some embodiments, the various operations, methods, and rules disclosed herein are implemented by instructions stored in memory. When the instructions are executed by the processor of one or more of computing devices 502 and 506, the instructions cause the processor to perform one or more of the operations or methods disclosed herein. Examples of operations include the operations of game play and enforcement of one or more rules of the game.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A method of playing a card game, the method comprising:

utilizing a computing device having a processing device and a memory device, the memory device storing instructions that, when executed by the processing device cause the processing device to:

obtain at least three wagers from a player;

deal at least six cards to the player as the player's cards;

identify three player hands from the player's cards, the three player hands including a one-card hand, a two-card hand, and a three-card hand;

provide an additional card to the player upon the player's choosing to purchase an additional card wherein the player can use the extra card to form the three player hands;

compare each of the three player hands to at least three other hands including another one-card hand, another two-card hand, and another three-card hand; and for each of the three player hands, determine whether the player has won the wager, including determining if the player hand is higher than at least one of the other hands.

2. The method of claim 1, further comprising:

for each of the three player hands, providing a payoff to the player if determined that the player has won the hand, and collecting one of the wagers from the player if determined that the player has lost the hand.

3. The method of claim 1, wherein the at least three wagers are of equal value.

4. The method of claim 1, wherein the other hands are the dealer's hands.

5. The method of claim 1, wherein the other hands are another player's hands.

6. The method of claim 1, wherein the three other hands are the dealer's three hands, and further comprising:

dealing at least six dealer's cards;

identifying the dealer's three hands from the at least six dealers cards by:

selecting a highest card as the one-card hand leaving at least five cards;

selecting two cards from the dealer's cards to make the highest two-card hand leaving at least three cards; and identifying the at least three cards as the three-card hand.

7. The method of claim 6, wherein if at least two cards of the at least six dealers cards have the same highest ranking, selecting a highest card as the one-card hand occurs after selecting two cards to make the highest two-card hand.

8. The method of claim 7, if the highest two-card hand can be made from at least three cards, selecting the highest at least three cards as the three-card hand before selecting two cards.

9. The method of claim 1, wherein determining whether the player has won the wager comprises determining that the player has lost the hand if the players hand ties the other hand.

10. The method of claim 1, wherein determining if the player hand is higher than the other hand utilizes a one-card hand ranking from highest to lowest wherein Ace is highest and Deuce is lowest.

11. The method of claim 1, wherein determining if the player hand is higher than the other hand utilizes a two-card hand ranking from highest to lowest comprising: a royal flush; a straight flush; a pair; a straight; a flush; and a high card.

12. The method of claim 1, wherein determining if the player hand is higher than the other hand utilizes a three-card hand ranking from highest to lowest comprising: a royal flush; a straight flush; a three-of-a-kind; a straight; a flush; a pair; and a high card.

13. The method of claim 1, further comprising receiving a fourth wager from the player and determining that the player has won the fourth wager if the three player hands are higher than the three other hands.

* * * * *